US005123465A

United States Patent [19]

Gabriel

[11] Patent Number: 5,123,465

[45] Date of Patent: Jun. 23, 1992

[54] METHOD OF MAKING A DRUM SHELL OR OTHER SUCH CIRCUMFERENTIAL COMPONENT

[75] Inventor: Paul Gabriel, Santa Cruz County

[73] Assignee: Solid Percussion, Inc., Watsonville, Calif.

[21] Appl. No.: 246,451

[22] Filed: Sep. 19, 1988

[51] Int. Cl.[5] ..... B27H 1/00; B27G 11/00

[52] U.S. Cl. ..... 144/349; 144/256.1; 144/270; 144/271; 144/380; 144/381; 144/360

[58] Field of Search ..... 144/254, 255, 256.1, 144/256.2, 256.3, 256.4, 259, 261, 262, 269, 270, 271, 380, 381, 360

[56] References Cited

U.S. PATENT DOCUMENTS

| | | | |
|---|---|---|---|
| 369,638 | 9/1887 | Godfrey et al. . | |
| 546,053 | 9/1895 | Palmer | 144/256.4 |
| 553,435 | 10/1895 | Campell . | |
| 613,725 | 11/1898 | Schmidt . | |
| 1,330,804 | 2/1920 | Haskell et al. . | |
| 1,536,071 | 5/1925 | Brown . | |
| 1,823,102 | 9/1931 | Homey . | |
| 1,879,288 | 9/1932 | Johnson | 144/259 |
| 2,312,333 | 3/1943 | Gramelspacher | 144/256.4 |
| 4,469,156 | 9/1984 | Norimoto et al. | 144/270 |

FOREIGN PATENT DOCUMENTS 70648 1/1928 Netherlands .

*Primary Examiner*—W. Donald Bray
*Attorney, Agent, or Firm*—Flehr, Hohbach, Test, Albritton & Herbert

[57] ABSTRACT

A method of making a drum shell or other such circumferential component from a single piece of wood which serves as a starting blank. This method comprises the steps of steam heating the blank a first time to a predetermined temperature and, thereafter, while the steam heated blank is still at approximately that temperature, forming it into a circumferential shape approximating the ultimate shape of the drum shell or other such component such that its opposite ends remain unconnected with one another. The blank is then allowed to cool, whereby to provide a circumferentially shaped blank having unconnected opposite ends. This circumferentially shaped blank is placed into a mold which more accurately defines the ultimate shape of the drum shell or other such component so that the opposite ends of the blank engage one another. It is again steam heated to a predetermined temperature while remaining in the mold and is thereafter dried and its opposite ends are glued together.

18 Claims, 5 Drawing Sheets

METHOD OF MAKING A DRUM SHELL OR OTHER SUCH CIRCUMFERENTIAL COMPONENT

The present invention relates generally to a technique for making circumferential components, and more particularly to a specific method of making a wooden drum shell.

Wooden drum shells are typically made from laminated layers of thin wood sheets. As will be described in detail hereinafter, applicants have discovered a unique method of making a drum shell or other such circumferential component from a single piece of wood in an uncomplicated and yet reliable manner. For purposes of simplicity, a method of making an annular drum shell will be described herein. It is to be understood, however, that the same method can be used to make other annular or otherwise circumferentially shaped members from a single piece of wood, for example, frames for port windows. This same method is also used to make strengthening hoops for the drum shell disclosed herein.

As will be described in more detail hereinafter, the present method actually contemplates providing as a starting blank a single elongated piece of wood having a predetermined length, width and thickness, and including opposite lengthwise ends. This blank is steam heated the first time to a predetermined temperature, preferably to a temperature of 212° F., in an unpressurized steam chamber. Thereafter, while the blank is still at approximately its initially heated temperature, it is formed into a circumferential shape generally approximating the ultimate shape of the drum shell such that its opposite ends remain unconnected with one another. The blank is then allowed to cool and retains this general circumferential shape, but with its opposite ends still unconnected. With the blank in this shape, it is placed in a mold which more accurately defines the ultimate shape of the drum shell, with opposite ends of the blank in engagement with one another. In an actual working embodiment, opposite ends of the blank are maintained in a fixed position in engagement with one another, and the mold is configured to subject the entire blank to lengthwise compression. With the blank in this condition, it is then steam heated to a predetermined temperature, preferably to a temperature of 212° F. in an unpressurized steam chamber. Thereafter, the blank is allowed to dry while either remaining in the first mentioned mold, which is preferably a stainless steel mold, or it is dried in a wooden mold, and its ends are glued together. When a second wooden mold is used, it also maintains the ends of the blank in a fixed position in engagement with one another and it is also configured to subject the entire blank to lengthwise compression.

In a preferred embodiment of the present invention, annular strengthening hoops are made from single pieces of wood in the same manner described above. These hoops are incorporated into the drum shell during the drum's final stages of formation, as will be seen.

As will also be seen, the way in which the blank is steam heated and the way in which both the stainless steel and wooden molds act on the blank are important contributions to the overall method disclosed herein. This method will be described in more detail hereinafter in conjunction with the drawings wherein.

Figure 2:
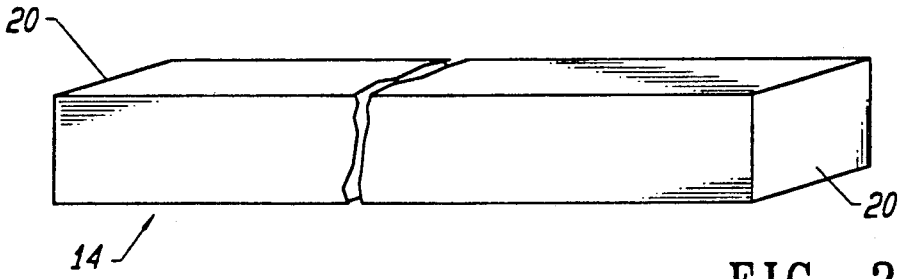
FIG. 2 is a perspective view of a single elongated piece of wood which serves as a starting blank for the drum shell shown in FIG. 1.
Figure 5:
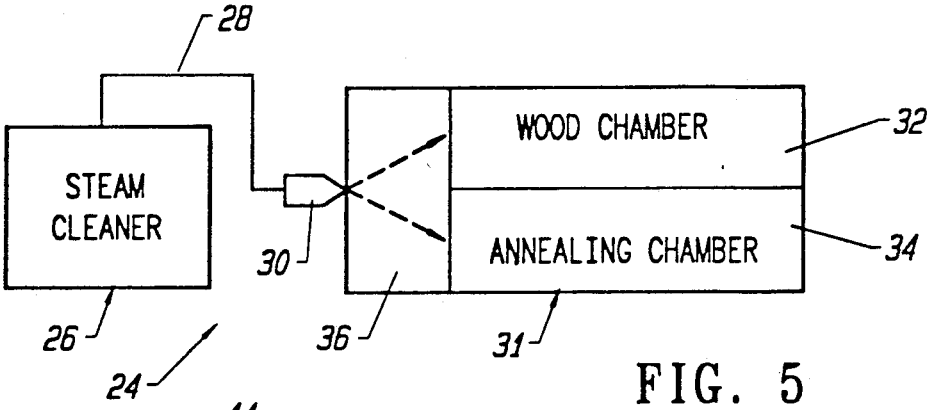
Figure 6:
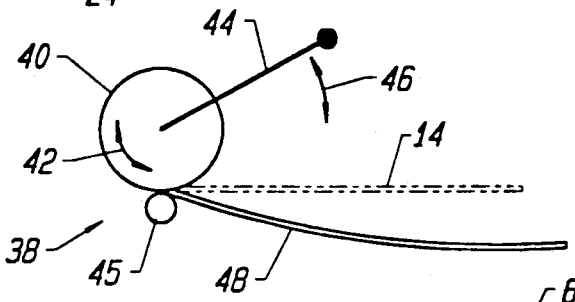
Figure 7:
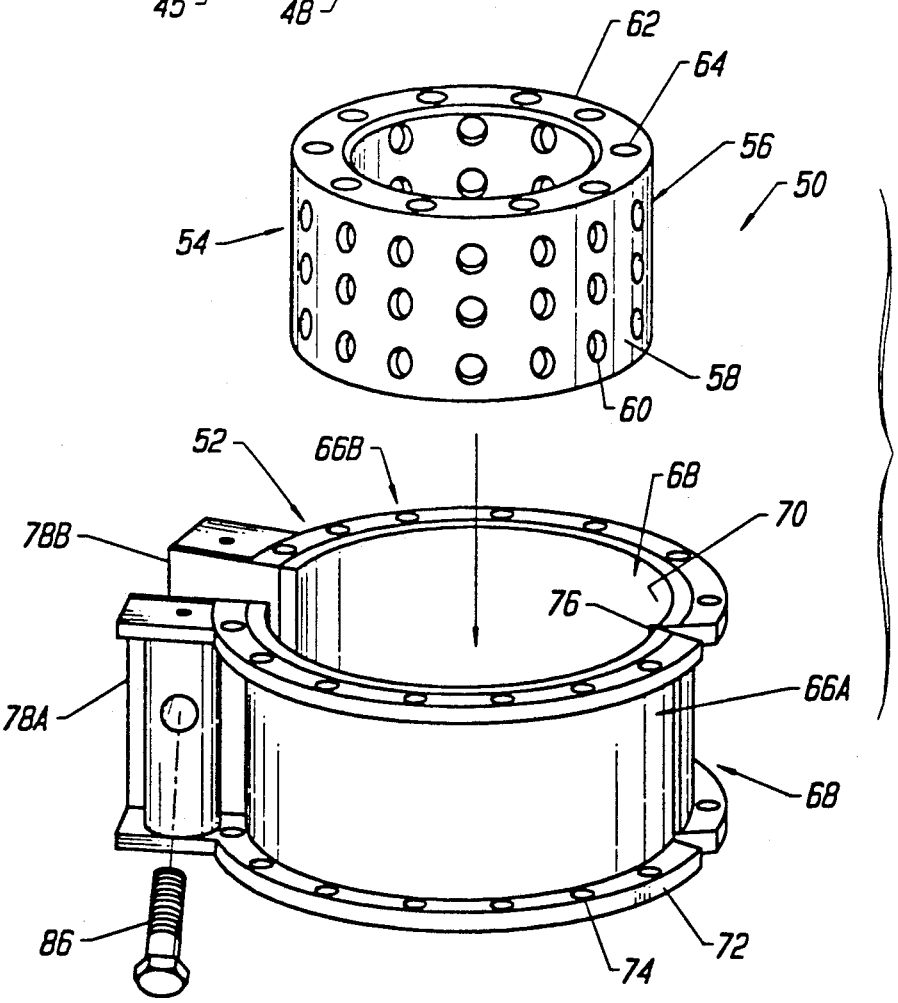
Figure 8:
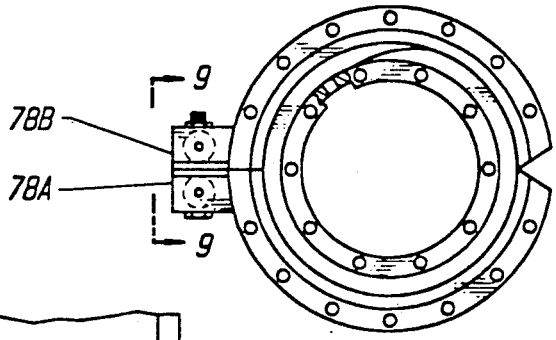
Figure 9:
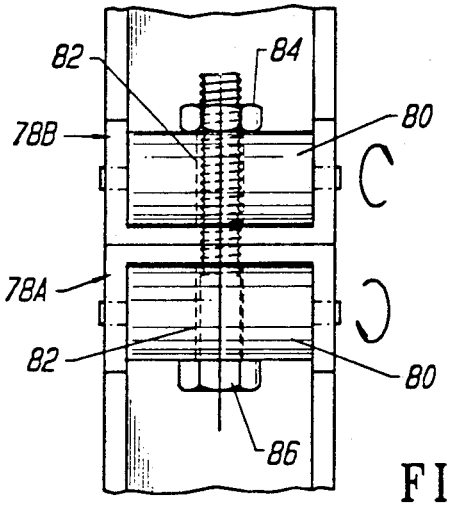
Figure 10:
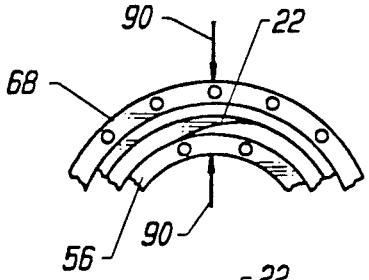
Figure 11:
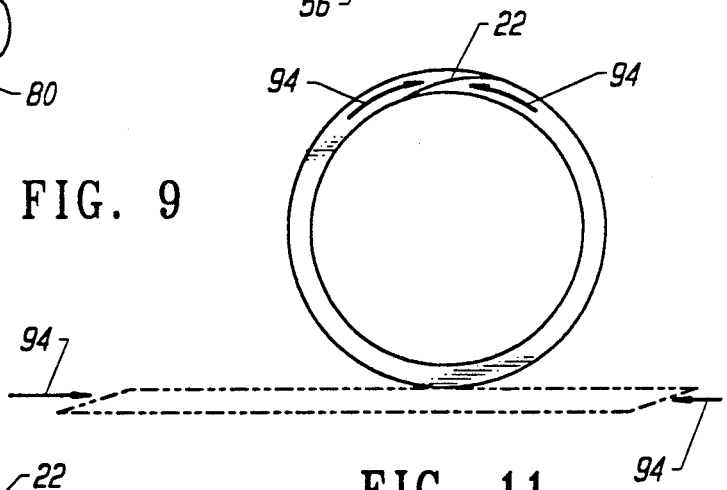
Figure 12:
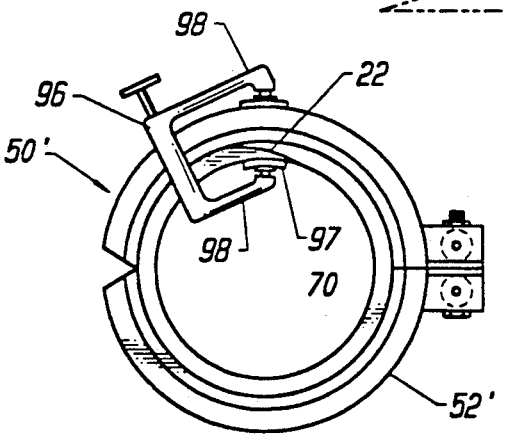
Figure 13:
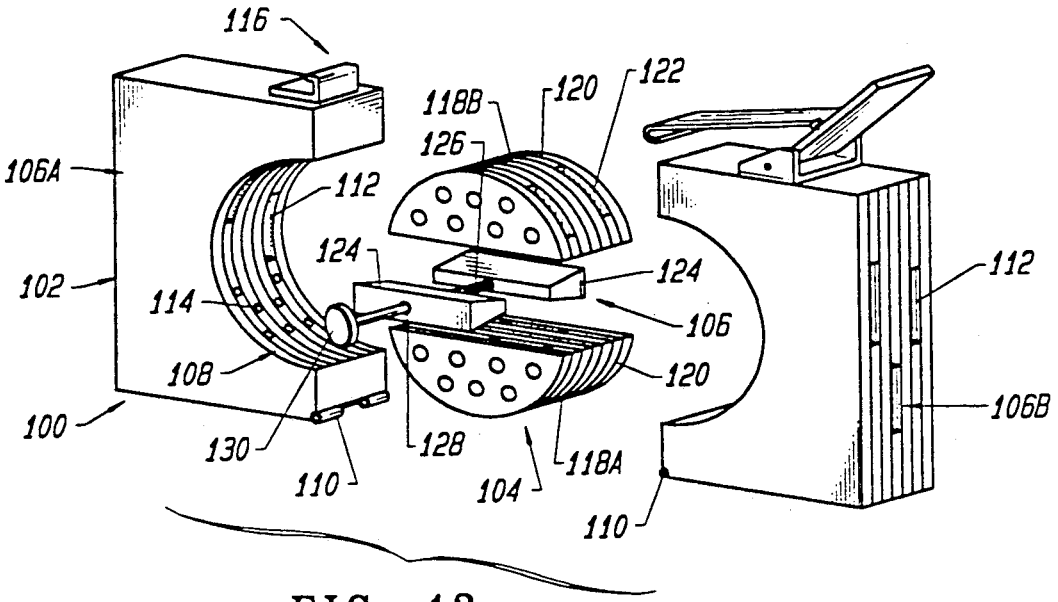
Figure 14:
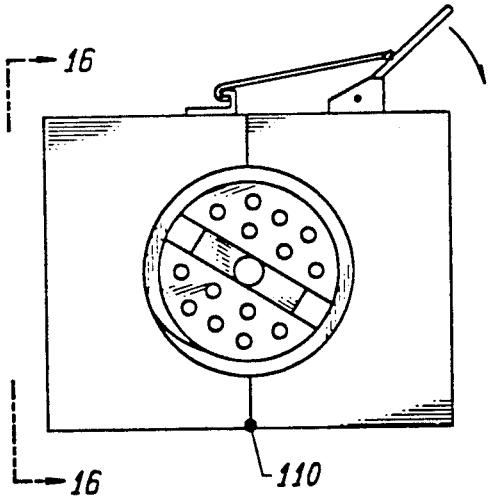
Figure 15:
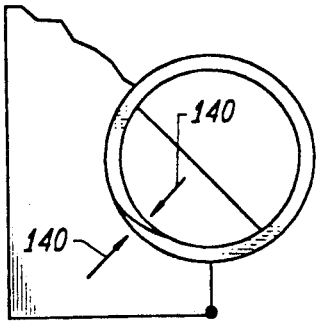
Figure 16:
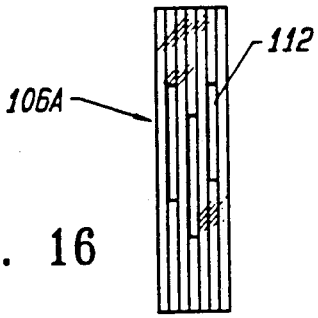
Figure 17:
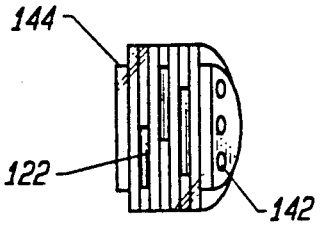

FIG. 5 diagrammatically illustrates an arrangement for steam heating the blank shown in FIG. 2 during various stages in the formation of the drum shell;

FIG. 6 is a diagrammatic illustration of an arrangement for rolling the blank of FIG. 2 in accordance with one step in the overall method;

FIG. 7 is an exploded perspective view of a first, preferably stainless steel, mold assembly for use in the method disclosed herein;

FIG. 8 is a side elevational view of the mold assembly of FIG. 7 in its assembled condition;

FIG. 9 is a sectional view of a part of the mold assembly of FIG. 8, taken generally along 9—9 in FIG. 8;

FIGS. 10 and 11 diagrammatically depict operational features of the mold assembly of FIGS. 7-9;

FIG. 12 is a diagrammatic illustration in side elevational view of a mold assembly corresponding in function to the mold assembly illustrated in FIGS. 7-9, but differing in design;

FIG. 13 is an exploded perspective view of a second, preferably mostly wooden, mold assembly used in the method disclosed herein;

FIG. 14 is a side elevational view of the mold assembly of FIG. 13 in its assembled condition;

FIG. 15 diagrammatically depicts an operational feature of the mold assembly of FIGS. 13 and 14;

FIG. 16 is a sectional view of the mold assembly of FIGS. 13 and 14, taken generally along lines 16—16 in FIG. 14; and FIG. 17 is a perspective view of one component of the mold assembly of FIGS. 13 and 14.

Figure 1:
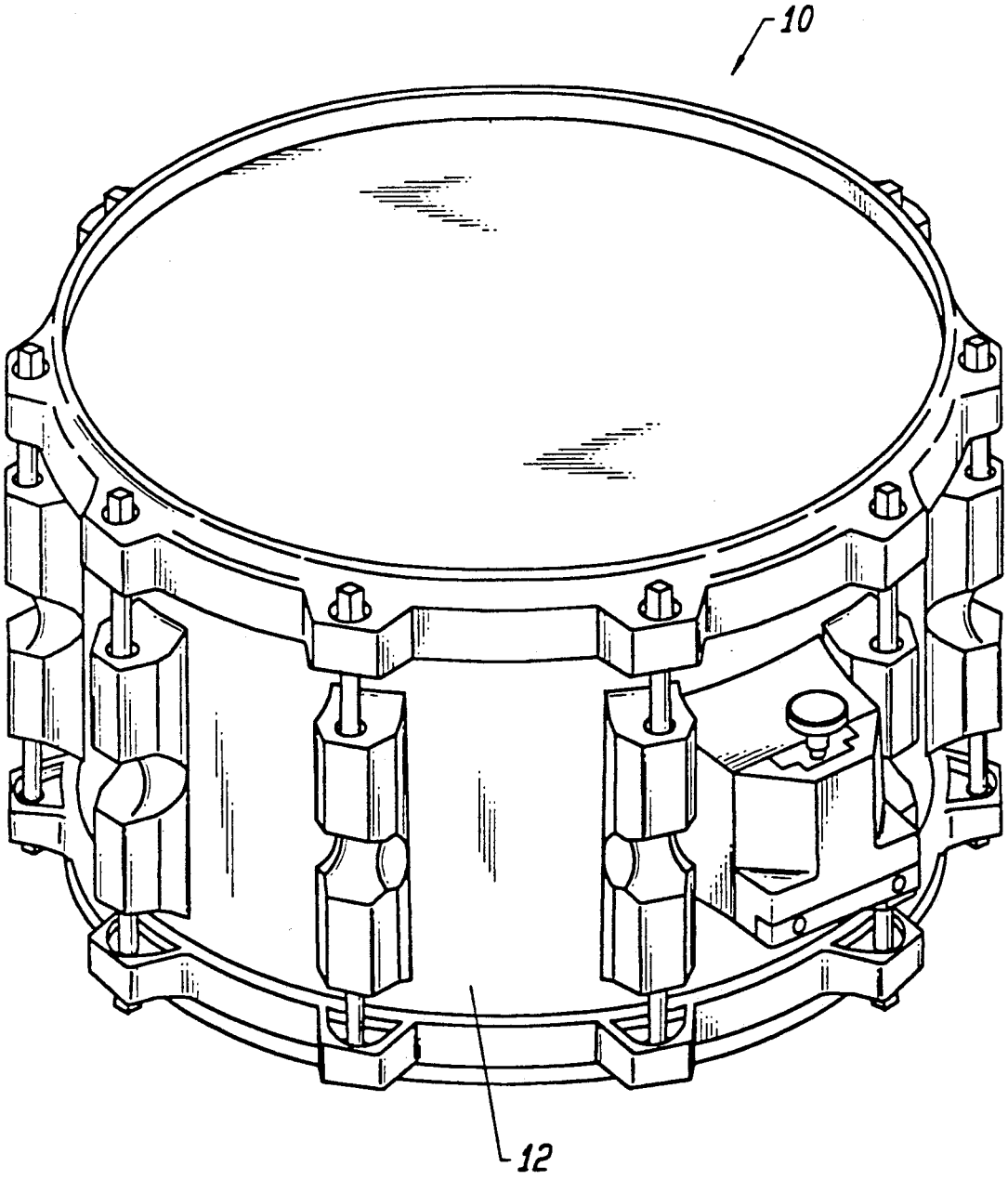
FIG. 1 is a perspective view of a snare drum including an annular drum shell made in accordance with the present invention.

Turning now to the drawings, wherein like components are designated by like reference numerals throughout the various figures, attention is first directed to FIG. 1. This figure illustrates a snare drum 10 including, among other components, a wooden shell 12 which is made in accordance with the present invention, as will be seen hereinafter. Specifically, in a preferred, actual working embodiment, drum shell 12 is constructed of a single piece of maple, birch, or rosewood. As will also be seen, the shell is internally strengthened by means of upper and lower annular reinforcement hoops, each of which is also made from a single piece of wood and formed into its annular shape in accordance with the present invention.

Turning specifically to FIG. 2, a single, elongated piece of wood serves as a starting blank for drum shell 12. The starting blank, which is generally designated by the reference number 14, is shown having predetermined lengthwise surfaces, a predetermined width and a predetermined thickness. The length of each side of the blank ultimately determines the diameter and circumference of the drum shell, its width determines the height of the drum shell, and its thickness determines the thickness of the drum shell. In an actual working embodiment of the present invention, the initially provided blank is approximately 5/16 inch thick and is dry wood, preferably either maple, birch, or rosewood. In an actual embodiment, its width is about 4 inches, 5½ inches, or 7 inches, and its overall length depends on the diameter of the ultimately shaped drum shell.

Figure 3:
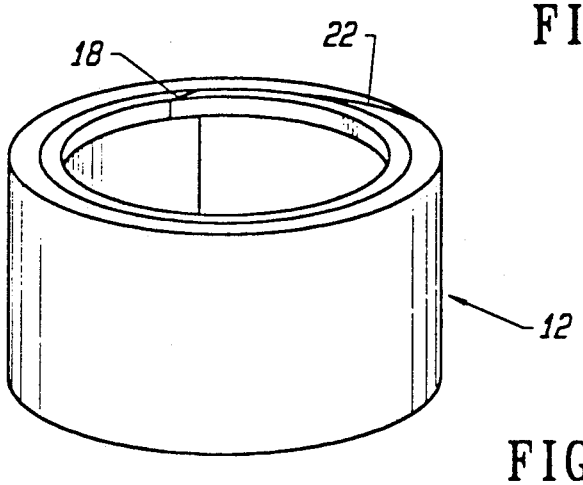
FIG. 3 is a perspective view of drum shell of FIG. 1 made from the blank shown in FIG. 2 and including reinforcing hoops made in accordance with the same method.

The ultimately formed drum shell 12 is shown in FIG. 3 without the rest of the components making up the overall drum, except for an annular reinforcement hoop 18 located around the inner top surface of the drum shell. A similar hoop is located at the bottom of the shell. Both hoops are made in the same way as the shell itself and bonded to the shell during the final stages of formation of the latter, as will be seen.

Figure 4:
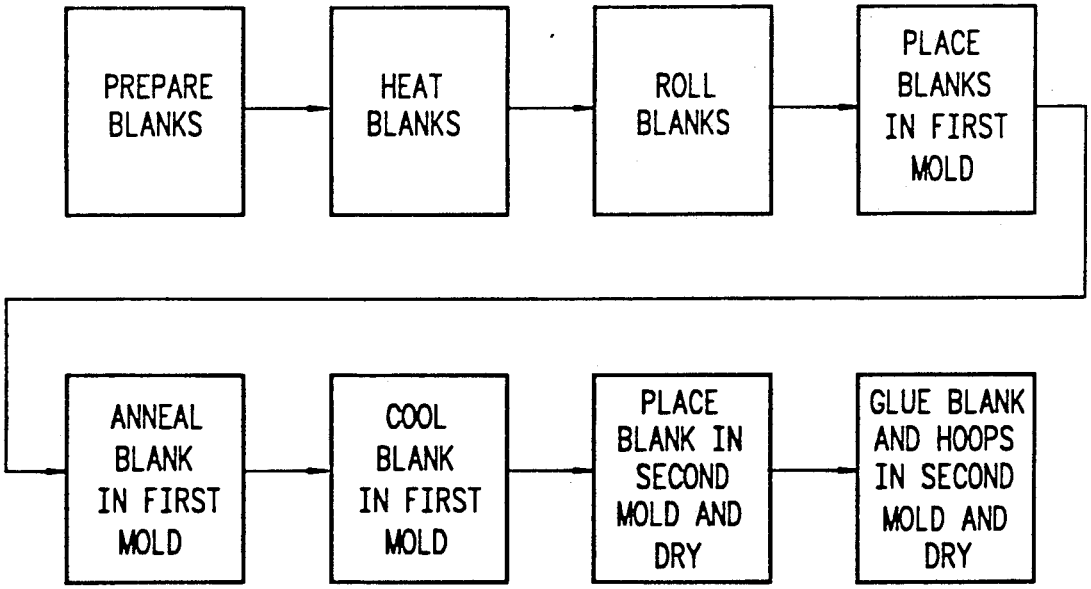
FIG. 4 is a block diagram diagrammatically depicting the various steps of the method used to make the drum shell shown in FIG. 3.

Referring now to FIG. 4, attention is directed to the way in which drum shell 12 is made in accordance with the present invention. In order to fully describe the present method, various other figures will be referred to from time to time in conjunction with FIG. 4. As an initial step in this method, starting blank 14 is provided with opposite ends 20 which are feathered in a conventional manner or otherwise provided with a suitable joint. In that way, when the blank is ultimately formed into a circumferential shape, its feathered ends engage one another to form a feathered joint shown at 22 in FIG. 3.

Starting blank 14 is steam heated a first time to a predetermined temperature, specifically to a temperature of 212° F. in an unpressurized steam heating chamber. An arrangement designed in accordance with the present invention for carrying out this step is illustrated diagrammatically in FIG. 5, and generally designated by the reference numeral 24. Arrangement 24 includes a conventional, readily providable steam cleaner 26. In an actual working embodiment, this steam cleaner is a Walters spray cleaning machine, Model No. 87. Its output is connected through a hose 28 to an output nozzle 30 so that the steamproducing chamber within the cleaner can be pressurized, thus allowing steam to be produced at temperatures above 212° F. In fact, in the preferred process, pressurized steam is produced at a temperature of 300° F. to 350° F.

Still referring to arrangement 24, it is shown including a cabinet 31 including two unpressurized chambers 32 and 34, and a readily providable manifold 36 which cooperates with valve 30 for directing steam in the valve into either chamber 32 or 34. Since these chambers are not pressurized but rather at atmospheric pressure, as the pressurized steam passes into either of these chambers it immediately drops in temperature to 212° F., the maximum temperature for steam at atmosphere pressure. Blank 14 is placed in chamber 32 and is steam heated within this chamber for a period of time sufficient to raise the temperature of the blank to that of the temperature within the chamber, that is, to 212° F. In an actual working embodiment, blank 14 is contained in chamber 32 for 15 minutes.

Once blank 14 is heated to the desired temperature, it is removed from chamber 32 and immediately thereafter, while still at approximately that temperature, it is formed into a circumferential shape approximating the ultimate shape of the drum such that its opposite feathered ends remain unconnected with one another. In an actual working method, a rolling arrangement generally indicated at 38 in FIG. 6 is utilized. This rolling arrangement includes a roller 40 supported by suitable means for rotation about its longitudinal axis, as indicated by two-way arrow 42. A handle 44 connected to one side of the roller is manually movable back and forth, as indicated by two-way arrow 46, in order to rotate the roller. A thin metal backing sheet 48 is fixedly connected at one end to roller 40 and rolls up over the outer surface of the roller between the latter and a backup roller 45 as roller 40 is rotated in the clockwise direction, as viewed in FIG. 6, and unrolls from the roller as the latter rotates in the counterclockwise direction. While blank 14 is still hot from chamber 32, it is immediately placed on the backing sheet 48, as indicated by dotted lines in FIG. 6. The roller is then rotated clockwise to cause sheet 48 to roll around it with the blank 14 therebetween. In this way, the blank is rolled around the roller and conforms to its outer periphery, although its ends remain unconnected. In this regard, the roller's outer surface corresponds in configuration to the inner surface of drum shell 12. Actually, the roller is slightly smaller than the inner surface of the drum shell. Therefore, the blank 14, after being rolled onto the roller approximates the shape of the drum or is actually slightly over bent. It is allowed to cool on the roller so that when it is removed it retains its generally circumferential shape with its end unconnected but still contains radial stresses tending to cause it to spring back slightly to its straight condition.

After the circumferentially shaped blank is removed from roller 40, it is placed in a mold which accurately defines the ultimate shape of the drum shell, and its opposite ends are retained therein in engagement with one another. More specifically, this step of placing the circumferentially shaped blank into the mold so that its opposite ends engage one another includes the steps of maintaining the ends of the blanks in a fixed position in engagement with one another while using the mold to subject the entire blank to lengthwise compression. With the blank in this condition, it is annealed in chamber 34 of overall arrangement 24. More specifically, it is steam heated to a predetermined temperature, specifically 212° F. in a preferred embodiment. Like chamber 32, chamber 34 is unpressurized. By steam heating the circumferentially shaped blank in this condition, radial stress in the blank are minimized so that the blank easily retains its circumferential shape.

Referring to FIGS. 7-9, attention is directed to a mold assembly 50 which is designed to maintain simultaneously the feathered ends 20 of circumferentially shaped blank 14 in a fixed position in engagement with one another while subjecting the entire blank to lengthwise compression. As will be described immediately below, this mold assembly is comprised of an outer mold piece 52 and an inner mold piece 54, both of which are preferably constructed of stainless steel in a preferred embodiment.

Referring specifically to FIG. 7 in conjunction with FIGS. 8 and 9, inner mold piece 54 of overall mold assembly 50 is shown including a hollow cylindrical main body 56 defining an outer cylindrical mold surface 58 including through holes 60 which are provided for venting moisture and heat, as will be seen hereinafter. The upper and lower ends of the cylindrical body include radially inward turned flanges 62 for adding strength to the overall mold piece. These flanges are also perforated at 64 in order to reduce weight to the overall mold piece and for venting heat and moisture. For reasons which will become apparent hereinafter, the diameter of mold surface 58 corresponds to the inner diameter of ultimately formed drum shell 12.

Mold piece 52 is constructed into sections **66*a* and 66*b* which, with certain small exceptions, are substantially identical. Each section includes a main semi-cylindrical mold body 68, and each mold body includes an inner semi-cylindrical mold surface 70. These mold bodies are reinforced by means of a spaced-apart outer reinforcement flanges 72 which are perforated at 74** to reduce weight.

Still referring to mold piece 52 of mold assembly 50, as illustrated in FIG. 8 in conjunction with FIG. 7, the two sections 66*a* and 66*b* are hinged together at adjoining ends by suitable hinge means 76 so that the two sections then pivot between the opened condition illustrated in FIG. 7 and a closed condition shown in FIG. 8. With the mold piece closed, as shown in FIG. 8, the two semi-cylindrical surfaces 70 come together to form a single cylindrical mold surface having a diameter corresponding to the outer diameter of the ultimately shaped drum shell 12. As will be seen, mold piece 52 is closed around mold piece 54 with the circumferentially shaped blank 14 therebetween. This requires a relatively large amount of force. As a result, the two sections 66*a* and 66*b* of mold piece 52 include confronting clamp plates 78*a* and 78*b* fixedly connected to the ends of those sections opposite hinge means 76.

Clamping plates 78*a* and 78*b* are positioned to engage one another in confronting relationship when the mold piece is closed, as best illustrated in FIGS. 8 and 9. As seen in this latter figure, each clamp plate is generally U-shaped and includes a cylindrical bolt guide 80 pivotally mounted by suitable means between the legs of its U-shaped plate. Each bolt guide includes a central through opening 82 for accommodating the threaded shaft of a bolt 86 and the bolt guide associated with clamping plate 78*b* in particular, includes a nut 84 around the bolt guides through hole, as shown in FIG. 9. In this way, when the mold piece 52 is closed or almost closed, the bolt 86 can be placed through the aligned holes 82 and thread connected to nut 84 in order to draw the clamping plates together. In this regard, as will be seen below, with the inner mold piece 54 and the blank 14 within other mold piece 52, the clamping plates 78*a* and 78*b* do not come together initially, but rather face each other at slightly outward angles. Therefore, in order to align holes 82 in order to accommodate bolt 86, the bolt guides 80 must pivot in the manner described, in order to obtain alignment of their holes 82 as the clamp plates are forced together. A pneuematically powered wrench may be used (and may be necessary) to provide sufficient force on bolt 86 to accomplish this. While clamping plates 78*a* and 78*b* have been described as U-shaped, segments of flanges 72 could be used as the legs of these plates.

Having described overall mold assembly 50, attention is now directed to the way in which it is used to (1) maintain the ends of blank 14 in a fixed position in engagement with one another while subjecting the entire blank to lengthwise compression and permanently shaping the blank into the final shape of drum shell 12. In this regard, it may be recalled that after blank 14 is rolled by arrangement 38, it is generally circumferential in shape with its ends unconnected. Actually, the ends are spaced apart slightly, so that the blank is more oblong than cylindrical. It is placed in this position around the outer mold surface 58 of inner mold piece 54 and its ends 20 are brought into engagement with one another in order to define joint 22 (see FIG. 3).

Once Blank 14 is positioned around the inner mold in the manner just described, manner, the outer mold 52 is closed over inner mold and the blank, and the clamping plates 78*a* and 78*b* are clamped together by means of bolt 86, as shown in FIG. 8. As this is carried out, confronting sections of the inner and outer mold surfaces 58 and 70 or opposite sides of feathered joint 22 serve to clamp the feathered ends into fixed engagement with one another, as diagrammatically illustrated in FIG. 10 by means of arrows 90. The blank is made sufficiently long and sufficiently thick so that this clamping action will take place. In this regard, when the blank is positioned tightly around the inner mold piece, with its ends against one another and before the outer mold piece is closed, its outer periphery is slightly greater than the outer periphery of outer mold surface 70 of mold piece 52. In an actual working embodiment, this difference is, for example, 1/16 inch to ⅛ inch. As a result, when outer mold piece 52 is closed around the blank, it not only clamps the ends of the blank together as shown in FIG. 10, but because the ends are clamped together, it places the blank in lengthwise compression in its effort to shorten the circumference of the blank. This is best illustrated in FIG. 11 of means of the arrows 94. If the blank were unrolled with the forces remaining in place, it would be seen that the forces oppose one another at opposite ends of the blank, thus placing the blank in compression along its entire length or actually along its entire circumference. This is depicted by dotted lines in FIG. 11. By annealing the blank in this condition, radial stresses which otherwise cause the blank to want to spring back to its original straight position are reduced substantially or entirely eliminated.

As stated above, once the blank is placed into mold assembly 50, the entire assembly and blank are placed in chamber 34 and the blank is annealed. The apertures 60 in inner mold piece 54 serve to allow moisture from the blank to escape the latter after the annealing process.

Overall mold assembly 50 has been described including both outer and inner mold pieces 52 and 54, respectively. FIG. 12 illustrates a modified mold assembly 50' which includes no inner mold piece at all. Its outer mold piece 52' may be identical to previously described mold piece 52, although in the embodiment illustrated in FIG. 12, it does not include reinforcement flanges 72. As shown in FIG. 12, after the blank 14 is rolled by means of arrangement 38, it is positioned in the mold surface 70 of mold piece 52' and its feathered ends 20 are fixedly maintained in place against one another by means of a conventional, readily providable C-clamp 96 and a clamping plate 97 which together form part of overall assembly 50' along with mold piece 52'. Clamping plate 97 rests directly under feathered joint 92 and is clamped in this position by means of the two clamping jaws 98 of clamp 96. Note specifically that one of the clamping jaws engages directly against plate 97 while the other clamping jaw engages the outer surface of mold piece 52. With the blank 14 maintained in this position, the mold piece 52' is closed in the same manner as outer mold piece 52 described above. Because the ends of the blank 14 are fixed, and because the blank is slightly longer than the molding surface defined by mold piece 52', the blank is placed in compression in the same manner as described above.

Returning to FIG. 4, once blank 14 within its mold assembly 50 or 50' is annealed, it is removed from annealing chamber 34 and allowed to cool to room temperature. It is then positioned in a second, wood mold which will be described hereinafter and allowed to dry. Thereafter, the mold is opened temporarily so that the ends of the blank can be glued together, whereupon it is placed back in the wood mold until the glue is set. During this latter step, hoops 18 are glued around the interior of the blank. In this regard, as will be seen, the wood mold has to be remodified to accommodate the hoops, as will be seen.

Referring to FIGS. 13–17, attention is now directed to a description of a mold assembly 100 which is constructed primarily of wood and which is used to carry out the process described immediately above. Mold assembly 100, like previously described mold assembly 50 or 50' is comprised of an outer mold piece 102 and an inner mold piece 104, as well as a wedge arrangement 106. These three components function in the same way as mold assembly 50 or 50' to maintain the ends of blank 14 in a fixed position in engagement with one another while subjecting the entire blank to lengthwise compression. However, because mold assembly 100 is constructed of wood, as opposed to stainless steel, and thus cannot be made to conform as precisely to the desired shape of drum shell 12 as can a stainless steel mold, it is designed differently to take into consideration this difference, as will be seen below.

As best seen in FIG. 13, outer mold piece 102 is formed from two sections, 106*a* and 106*b* which are substantially identical, with certain small exceptions to be noted. Each section includes an inner semi-cylindrical mold surface 108 and the two sections are hinged together by cooperating hinge means 110 for movement between an open condition similar to the open condition of mold piece 52 illustrated in FIG. 7, and a closed condition shown in FIG. 14. With mold piece 102 in its closed condition, the two mold surfaces 108 define a combined cylindrical mold surface corresponding to the outer diameter of drum shell 12. Moisture venting slots 112 and apertures 114 are provided in mold sections 106*a* and 106*b* and through mold surfaces 108 for purposes of venting moisture. The reason for both types of venting arrangements will be discussed below. As indicated above, sections 106*a* and 106*b* of mold piece 102 are hinged together by hinge means 110. A readily providable closure mechanism 116 is used to close the mold piece over mold piece 104 and blank 14, as will be seen hereinafter. While this may require a relatively large amount of effort, the mechanism 116 is suitable for that purpose. A bolt-air wrench mechanism could be readily substituted.

Still referring to FIG. 13, inner mold piece 104 is itself formed of two sections, 118*a* and 118*b*, which respectively include outer semi-cylindrical mold surfaces 120. These outer surfaces are intended to combine in a way which represents the inner diameter of drum shell 12. Because sections 118*a* and 118*b* are made of wood, as opposed to stainless steel, they cannot be accurately made to accomplish this. Moreover, it must be disassembled to remove from the center of the ultimately formed shell. Therefore, as will be seen, the overall mold assembly includes wedge arrangement 106. Like mold sections 106*a* and 106*b*, mold sections 118*a* and 118*b* are vented by means of slotted vents 122 and perforations (not shown).

The wedge arrangement 106 is comprised of two confronting wedges 124 which are mounted on a threaded shaft 126 which is thread connected through a cooperating nut 128 fixedly connected to one of the wedges such that rotation of the threaded shaft causes the wedges to move either toward one another or away from one another. A hex head 130 or other such wrench clamping means is provided on one end of the threaded shaft to rotate the latter by suitable means, for example by means of a pneumatic wrench.

Having described overall mold assembly 100, attention is now directed to the way in which it functions to maintain the ends of blank 14 in a fixed position in engagement with one another while subjecting the entire blank to a lengthwise compression. As illustrated best in FIG. 14, after the circumferentially shaped blank is cooled in mold 50 or 50' and removed therefrom, it is placed over sections 118*a* and 118*b* of inner mold piece 104 within mold piece 102, which is not forced closed, but loosely held in a closed position. The wedge arrangement 106 is adjusted to position the mold surfaces 120 of mold sections 118*a* and 118*b* tightly against the inner surface of concentrically shaped blank 14. Thereafter, the outer mold 102 is forced into its closed position around the outer surface of the circumferentially shaped blank. This causes the feathered ends of the blank to be clamped in a fixed position against one another, as diagrammatically illustrated by arrows 140 in FIG. 15. At the same time and as a result of this, the outer mold section 102 subjects the blank to lengthwise compression in the same manner as outer mold piece 52, as seen in FIG. 11.

Once the circumferentially shaped blank 14 is within mold assembly 100 in the manner described immediately above, it is allowed to dry, preferably in a dry room or a room that includes a conventional dehumidifier. As indicated above, both mold piece 102 and mold piece 104 include venting slots and apertures. In an actual working embodiment, each of the wood mold pieces is formed from individual sheets of wood laminated together, much like plywood, as illustrated in FIGS. 16 and 17. These venting slots 112 and 122 are provided by leaving out sections of these layers, again as illustrated in FIGS. 16 and 17. In the case of the outer mold piece, these slots extend all the way out to the back end of each section 106*a* and 106*b*, as best illustrated in FIG. 13. In the case of mold piece 104, cross venting holes 142 are also provided into the slots. In both cases, the venting apertures 114 in mold piece 100 and those in the mold piece 104 are provided at the location where feathered joint 122 is clamped (see FIG. 15). In that way, there is no fear that the feathered ends of the blank will be deformed into the smaller spaces (as contrasted with the larger slotted spaces).

Once circumferentially shaped blank 14 is placed into mold assembly 100 and allowed to dry, the mold assembly is opened sufficient to gain access to the blank and glue its feathered ends. At the same time, where the ultimately formed drum shell is to have reinforcement hoops, these hoops are glued in place within the shell and the shell and hoops are returned to the mold. In this regard, it may be necessary to provide slightly modified inner mold sections 118*a* and 118*b*, as shown in FIG. 17. Specifically, the FIG. 17 version includes step surfaces 144 to accommodate the hoops. Also, in an actual, preferred embodiment of the present invention, the hoops are made in the same way as the drum shell, that is, using a similar stainless steel mold and a similar wood mold. However, rather than being made individually, a number of hoops are made from a single wider starting blank and eventually cut into a number of lesser wide hoops.

Once the drum shell and hoops (if any) are glued and the mold 100 is again closed, it is allowed to dry until the moisture content is 6% or less or, in any event, until the glue has completely hardened or cured.

The method described above contemplated two specific mold assemblies, stainless steel mold assembly 50 or 50' and wood mold assembly 100. It is possible to use the stainless steel mold to serve both functions. However, this can be quite expensive since a large number of stainless steel molds would be necessary. This is because the drying time (using the wood mold assembly) is substantially longer than the annealing time. Nevertheless, the present method contemplates using the stainless steel molds throughout the process or possibly even a hard plastic mold capable of withstanding the pressures and temperatures which they would be subjected to in the present process.

It is also to be understood that the present process is not limited to making wooden drum shells or reinforcement hoops, but other cylindrical or otherwise circumferential components.

I claim:

1. A method of making a drum shell or other such circumferential component from a single piece of wood, said method comprising the steps of:

(a) initially providing as a starting blank a single elongated piece of wood having a predetermined length, width and thickness and including opposite lengthwise ends;

(b) steam-heating said blank a first time to a predetermined temperature;

(c) thereafter, while said steam-heated blank is still at approximately said predetermined temperature, forming it into a circumferential shape approximating the ultimate shape of said drum shell or other such component such that its opposite ends remain unconnected with one another, whereby to provide a circumferentially shaped blank having unconnected opposite ends;

(d) placing said circumferentially shaped blank into a mold which accurately defines the ultimate shape of said drum shell or other such component with the opposite ends of the blank engaging one another;

(e) steam-heating said circumferentially shaped blank to a predetermined temperature while the blank remains in said mold; and (f) thereafter drying said circumferentially shaped blank and gluing the opposite ends thereof together, whereby to form said drum shell or other such circumferential component.

2. A method according to claim 1 wherein said single elongated piece of wood is initially provided dry, as opposed to being green.

3. A method according to claim 2 wherein said single piece of wood is initially provided with a thickness of approximately 5/16".

4. A method according to claim 1 wherein said blank is steam-heated a first time to a temperature of about 212° F. at approximately atmospheric pressure.

5. A method according to claim 4 wherein said step of steam-heating said blank for the first time includes the steps of:

(a) placing said blank in an unpressurized steam chamber;

(b) generating a supply of pressurized steam at a temperature above 212° F. and directing said pressurized steam through a nozzle into said unpressurized steam chamber, whereby to heat the latter to 212° F.

6. A method according to claim 5 wherein said supply of pressurized steam is generated from a steam cleaning apparatus.

7. A method according to claim 1 wherein the step of placing said circumferentially shaped blank into said mold with the opposite ends of the blank engaging one another includes the steps of:

(a) maintaining said ends of said blank in a fixed position in engagement with one another; and (b) using said mold to subject the entire blank to lengthwise compression.

8. A method according to claim 7 wherein said starting blank is initially provided with opposite lengthwise ends which are feathered complementary to one another to provide a feathered joint when placed in engagement with one another and wherein said step of maintaining said ends of said blank in said fixed position in engagement with one another includes placing said complementary feathered ends against each other to form said feathered joint.

9. A method according to claim 8 wherein said step of maintaining said ends of said blank in a fixed position to form said feathered joint includes the step of clamping said ends together and to said mold.

10. A method according to claim 9 wherein said clamping step includes placing a clamp means across said feathered joint and a portion of said mold.

11. A method according to claim 7 wherein said step of using said mold to subject said blank to lengthwise compression includes the step of forcing the outer surface of said blank to conform to an outer circumferential mold piece which forms part of said mold and which has a circumference that is slightly less than the circumference of said blank with its ends maintained in said fixed position.

12. A method according to claim 7 wherein said circumferentially shaped blank within said mold is steam-heated to a temperature of about 212° at approximately atmospheric pressure.

13. A method according to claim 1 wherein said mold is a stainless steel mold and wherein said step of drying and gluing said circumferentially shaped blank includes placing said blank in a second wooden mold with its opposite ends engaging one another.

14. A method according to claim 13 wherein the step of placing said circumferentially shaped blank into said second mold so that the opposite ends of the blank engage one another includes the steps of:

(a) maintaining said ends of said blank in a fixed position in engagement with one another; and (b) using said second mold to subject the entire blank to lengthwise compression.

15. A method according to claim 1 wherein said step of drying and gluing said circumferentially shaped blank includes maintaining said blank in said mold with its opposite ends engaging one another.

16. A method according to claim 15 wherein said lastmentioned step of maintaining said blank in said mold with its opposite end engaging one another includes the steps of:

(a) maintaining said ends of said blank in a fixed position in engagement with one another; and (b) using said mold to subject the entire blank to lengthwise compression.

17. A method according to claim 1 wherein said circumferential component is a drum shell.

18. A method according to claim 1 wherein said circumferential component is a strengthening hoop for a drum shell.

* * * * *